US006660178B2

(12) United States Patent
Arai et al.

(10) Patent No.: US 6,660,178 B2
(45) Date of Patent: Dec. 9, 2003

(54) MAGNETIC POWDER AND BONDED MAGNET

(75) Inventors: Akira Arai, Nagano-ken (JP); Hiroshi Kato, Okaya (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/840,632

(22) Filed: Apr. 23, 2001

(65) Prior Publication Data

US 2002/0023697 A1 Feb. 28, 2002

(30) Foreign Application Priority Data

Apr. 24, 2000 (JP) ..... 2000-122156
Dec. 28, 2000 (JP) ..... 2000-399878

(51) Int. Cl.[7] ..... H01F 1/08

(52) U.S. Cl. ..... 252/62.54; 148/301; 148/302; 420/83

(58) Field of Search ..... 148/301, 302, 148/303; 420/83, 121, 435; 252/62.54

(56) References Cited

U.S. PATENT DOCUMENTS 5,209,789 A * 5/1993 Yoneyama et al. ..... 148/302
5,665,177 A 9/1997 Fukuno et al.
5,993,939 A 11/1999 Fukuno et al.
6,187,217 B1 * 2/2001 Arai et al. ..... 148/302

FOREIGN PATENT DOCUMENTS

| | | |
|---|---|---|
| EP | 0936633 A1 | 8/1999 |
| JP | 01129402 | 5/1989 |
| JP | 05-175023 | 7/1993 |
| JP | 05-269549 | 10/1993 |

OTHER PUBLICATIONS

European Search Report, EP Application No. 01109917.

* cited by examiner

*Primary Examiner*—John Sheehan
(74) *Attorney, Agent, or Firm*—Harness, Dickey & Pierce, P.L.C.

(57) ABSTRACT

Disclosed herein is a magnetic powder which can provide a bonded magnet having high mechanical strength and excellent magnetic properties. The magnetic powder has an alloy composition containing a rare-earth element and a transition metal, wherein the magnetic powder includes particles each of which is formed with a number of ridges or recesses on at least a part of a surface thereof. In this magnetic powder, it is preferable that when the mean particle size of the magnetic powder is defined by a$\mu$m, the average length of the ridges or recesses is equal to or greater than a/40 $\mu$m. Further, preferably, the ridges or recesses are arranged in roughly parallel with each other so as to have an average pitch of 0.5–100 $\mu$m.

17 Claims, 4 Drawing Sheets

MAGNETIC POWDER AND BONDED MAGNET

BACKGROUND OF THE INVENTION

1. Field of the Invention

The present invention relates to a magnetic powder and a bonded magnet, and more specifically relates to a magnetic powder and a bonded magnet manufactured using the magnetic powder.

2. Description of the Prior Art

For reduction in size of motors, it is desirable that a magnet has a high magnetic flux density (with the actual permeance) when it is used in the motor. Factors for determining the magnetic flux density of a bonded magnet include magnetization of the magnetic powder and the content of the magnetic powder contained in the bonded magnet. Accordingly, when the magnetization of the magnetic powder itself is not sufficiently high, a desired magnetic flux density cannot be obtained unless the content of the magnetic powder in the bonded magnet is raised to an extremely high level.

At present, most of practically used high performance rare-earth bonded magnets are isotropic bonded magnets which are made using R—TM—B based magnetic powder (where, R is at least one kind of rare-earth elements and TM is at least one kind of transition metals). The isotropic bonded magnets are superior to the anisotropic bonded magnets in the following respect; namely, in the manufacture of the isotropic bonded magnet, the manufacturing process can be simplified because no magnetic field orientation is required, and as a result, the rise in the manufacturing cost can be restrained. On the other hand, however, the conventional isotropic bonded magnets represented by bonded magnets using the R—TM—B based magnetic powder involve the following problems.

(1) The conventional isotropic bonded magnets do not have a sufficiently high magnetic flux density. Namely, because the magnetic powder that is used has poor magnetization, the content of the magnetic powder to be contained in the bonded magnet has to be increased. However, the increase in the content of the magnetic powder leads to the deterioration in the moldability of the bonded magnet, so there is a certain limit in this attempt. Moreover, even if the content of the magnetic powder is somehow managed to be increased by changing the molding conditions or the like, there still exists a limit to the obtainable magnetic flux density. For these reasons, it is not possible to reduce the size of the motor by using the conventional isotropic bonded magnets.

(2) Although there are reports concerning nanocomposite magnets having high remanent magnetic flux densities, their coercive forces, on the contrary, are so small that the magnetic flux density (for the permeance in the actual use) obtainable when they are practically used in motors is very low. Further, these magnets have poor heat stability due to their small coercive forces.

(3) The mechanical strength of the conventional bonded magnets is low. Namely, in these bonded magnets, it is necessary to increase the content of the magnetic powder to be contained in the bonded magnet in order to compensate the low magnetic properties of the magnetic powder. This means that the density of the bonded magnet is required to be extremely high. As a result, the mechanical strength of the bonded magnet becomes low.

SUMMARY OF THE INVENTION

In view of the above problems involved in the conventional bonded magnets, it is an object of the present invention to provide a magnetic powder which can produce a bonded magnet having high mechanical strength and excellent magnetic properties.

In order to achieve the above object, the present invention is directed to a magnetic powder having an alloy composition containing a rare-earth element and a transition metal, wherein the magnetic powder includes particles each of which is formed with a number of ridges or recesses on at least a part of a surface thereof.

According to the magnetic powder, it is possible to provide a bonded magnet having high mechanical strength and excellent magnetic properties.

In the present invention, it is preferred that when the mean particle size of the magnetic powder is defined by a$\mu$m, the average length of the ridges or recesses is equal to or greater than a/40 $\mu$m. This makes it possible to provide a bonded magnet having higher mechanical strength and more excellent magnetic properties.

Further, it is also preferred that the average height of the ridges or the average depth of the recesses is 0.1–10 $\mu$m. This also makes it possible to provide a bonded magnet having higher mechanical strength and more excellent magnetic properties.

Furthermore, it is also preferred that the ridges or recesses are arranged in roughly parallel with each other so as to have an average pitch of 0.5–100 $\mu$m. This also makes it possible to provide a bonded magnet having higher mechanical strength and more excellent magnetic properties.

In the present invention, it is also preferred that the magnetic powder is produced by milling a melt spun ribbon manufactured using a cooling roll. This also makes it possible to provide a bonded magnet having excellent magnetic properties especially excellent coercive force.

Further, in the present invention, it is also preferred that the mean particle size of the magnetic powder is 5–300 $\mu$m. This also makes it possible to provide a bonded magnet having higher mechanical strength and more excellent magnetic properties.

Furthermore, it is also preferred that the ratio of an area of the part of the particle where the ridges or recesses are formed with respect to an entire surface area of the particle is equal to or greater than 15%. This also makes it possible to provide a bonded magnet having higher mechanical strength and more excellent magnetic properties.

In the present invention, it is also preferred that the magnetic powder has been subjected to a heat treatment during the manufacturing process thereof or after the manufacture thereof. By this heat treatment, it is possible to provide a bonded magnet having further excellent magnetic properties.

Further, it is also preferred that the magnetic powder is composed of a composite structure having a hard magnetic phase and a soft magnetic phase. This also makes it possible to provide a bonded magnet having especially excellent magnetic properties. In this case, the average crystal grain size of each of the hard magnetic phase and the soft magnetic phase is preferably 1–100 nm. This makes it possible to provide a bonded magnet having excellent magnetic properties, especially excellent coercive force and rectangularity.

The another aspect of the present invention is directed to a bonded magnet which is manufactured by binding the magnetic powder as claimed in any one of claims 1 to 10 with a binding resin. This makes it possible to provide a bonded magnet having high mechanical strength and excellent magnetic properties.

In this case, it is preferred that the bonded magnet is manufactured by means of warm molding. By using this method, bonding strength between the magnetic powder and the biding resin is enhanced and the void ratio of the bonded magnet is lowered, so that it becomes possible to provide a bonded magnet having a high density and having especially excellent mechanical strength and magnetic properties.

Further, in this case, it is also preferred that the binding resin enters the recesses or the gaps between the ridges of the particles. This also makes it possible to provide a bonded magnet having especially excellent mechanical strength and magnetic properties.

Further, in these bonded magnets, it is preferred that the intrinsic coercive force $H_{cJ}$ at a room temperature is 320–1200 kA/m. This makes it possible to provide a bonded magnet having excellent heat resistance and magnetizability as well as a satisfactory magnetic density.

Furthermore, it is also preferred that the maximum energy product $(BH)_{max}$ is equal to or greater than 40 kJ/m$^3$. By using such a bonded magnet, it is possible to provide small and high performance motors.

Further, in the present invention, it is also preferred that the content of the magnetic powder contained in the bonded magnet is 75–99.5 wt %. This makes it possible to provide a bonded magnet having excellent mechanical strength and magnetic properties with maintaining excellent moldability.

Furthermore, in the present invention, it is also preferred that the mechanical strength of the bonded magnet which is measured by the shear strength by punching-out test is equal to or greater than 50 MPa. This makes it possible to provide a bonding magnet having especially high mechanical strength.

These and other objects, structures and advantages of the present invention will be apparent from the following detailed description of the invention and the examples taken in conjunction with the appended drawings.

DETAILED DESCRIPTION OF THE INVENTION

Figure 1:
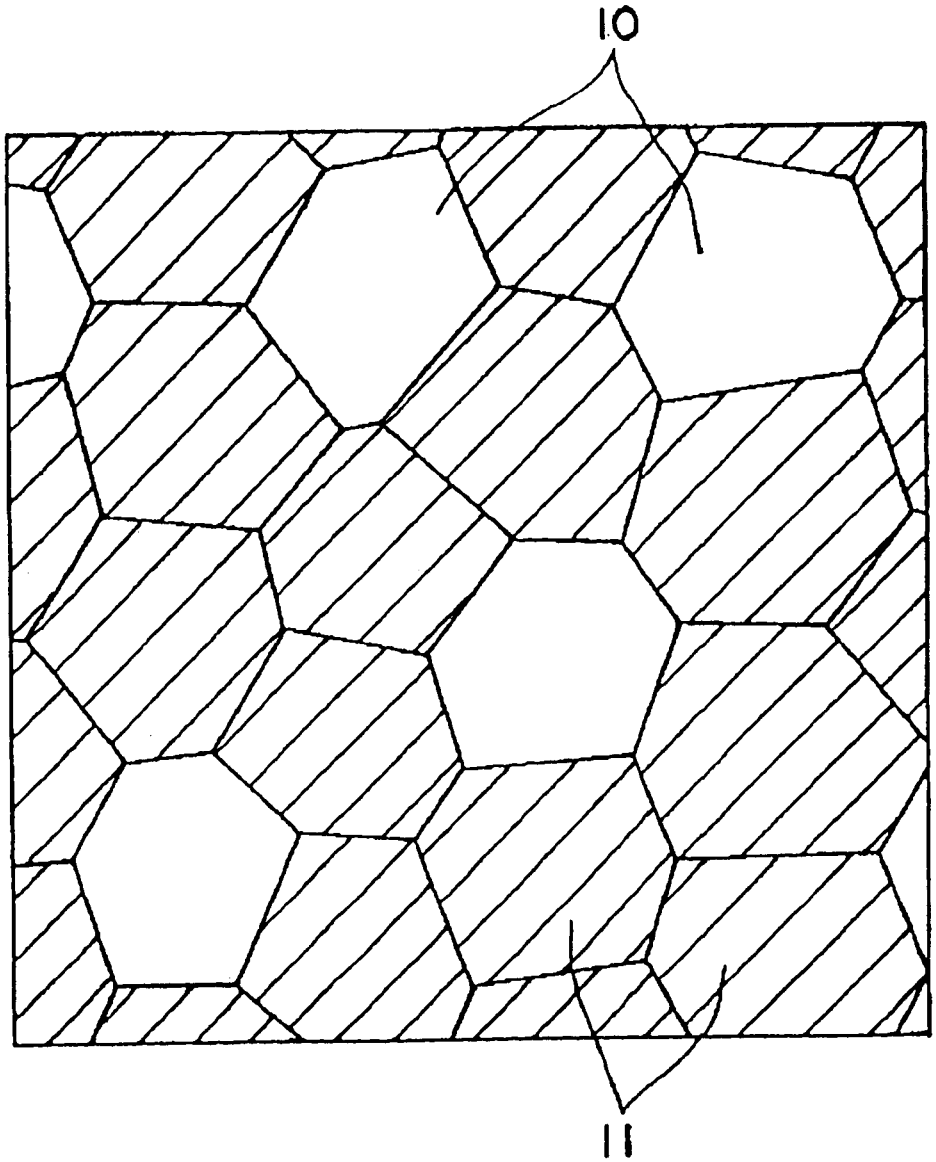
FIG. 1 is an illustration which schematically shows one example of the composite structure (nanocomposite structure) of the magnetic powder of the present invention.

Hereinbelow, embodiments of the magnetic powder and bonded magnet according to the present invention will be described in detail.

The magnetic powder of the present invention has an alloy composition containing a rare-earth element and a transition metal. In this case, any one of the following alloys is preferably used.

(1) An alloy containing as basic components thereof a rare-earth element mainly containing Sm and a transition metal mainly containing Co (hereinafter, referred to "as Sm—Co based alloys").

(2) An alloy containing as basic components thereof R (here, R is at least one kind of the rare-earth elements containing Y), a transition metal mainly containing Fe (TM) and B (hereinafter, referred to as "R—TM—B based alloys").

(3) An alloy containing as basic components thereof a rare-earth element mainly containing Sm, a transition metal mainly containing Fe and an interstitial element mainly containing N (hereinafter, referred to as "Sm—Fe—N based alloys").

(4) An alloy containing as basic components thereof R (here, R is at least one kind of the rare-earth elements containing Y) and a transition metal such as Fe and having a composite structure (including a nanocomposite structure) in which a soft magnetic phase and a hard magnetic phase are adjacently existed (including the case where they are adjoined through an intergranular boundary phase).

(5) A mixture of two or more of the above-mentioned alloy compositions (1) to (4). In this case, the advantages of the alloy compositions to be mixed can be enjoyed, so that more excellent magnetic properties can be obtained easily.

Typical examples of the Sm—Co based alloys include $SmCo_5$ and $Sm_2TM_{17}$ (here, TM is a transition metal).

Typical examples of the R—Fe—B based alloys include Nd—Fe—B based alloys, Pr—Fe—B based alloys, Nd—Pr—Fe—B based alloys, Nd—Dy—Fe—B based alloys, Ce—Nd—Fe—B based alloys, Ce—Pr—Nd—Fe—B based alloys, and one of these alloys in which a part of Fe is substituted with other transition metal such as Co or Ni or the like.

Typical examples of the Sm—Fe—N based alloys include $Sm_2Fe_{17}N_3$ which is formed by nitrifying a $Sm_2Fe_{17}$ alloy and Sm—Zr—Fe—Co—N based alloys having a $TbCu_7$ phase as a main phase. In this regard, in the case of the Sm—Fe—N based alloys, normally, N is introduced with the form of interstitial atom by subjecting the melt spun ribbon to an appropriate heat treatment to nitrify it after the melt spun ribbon has been manufactured.

In this connection, examples of the rare-earth elements mentioned above include Y, La, Ce, Pr, Nd, Pm, Sm, Eu, Gd, Tb, Dy, Ho, Er, Tm, Yb, Lu, and a misch metal, and one or more of these rare-earth metals may be contained. Further, examples of the transition metals include Fe, Co, Ni and the like, and one or more of these metals may be contained.

Further, in order to enhance magnetic properties such as coercive force and maximum energy product and the like, or in order to improve heat resistance and corrosion resistance, the magnetic material may contain one or more of Al, Cu, Ga, Si, Ti, V, Ta, Zr, Nb, Mo, Hf, Ag, Zn, P, Ge, Cr and W, as needed.

Figure 2:
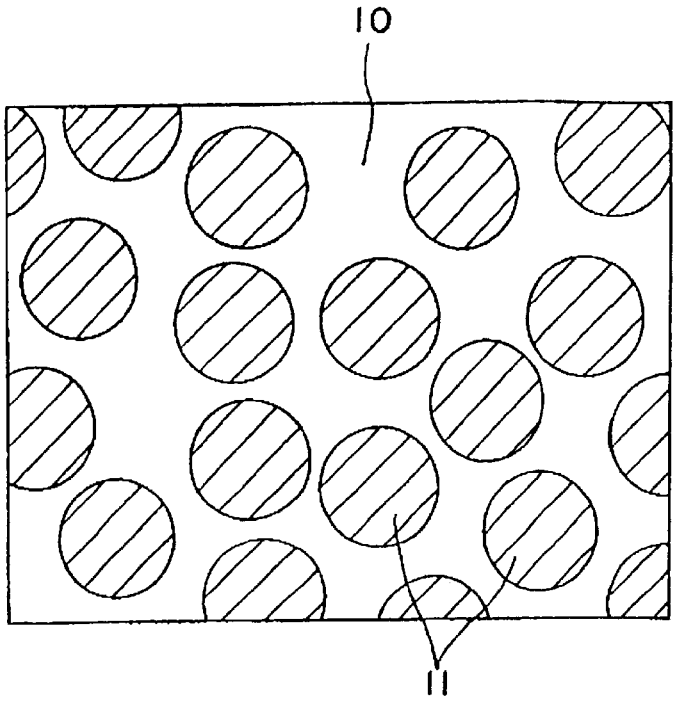
FIG. 2 is an illustration which schematically shows another example of the composite structure (nanocomposite structure) of the magnetic powder of the present invention.
Figure 3:
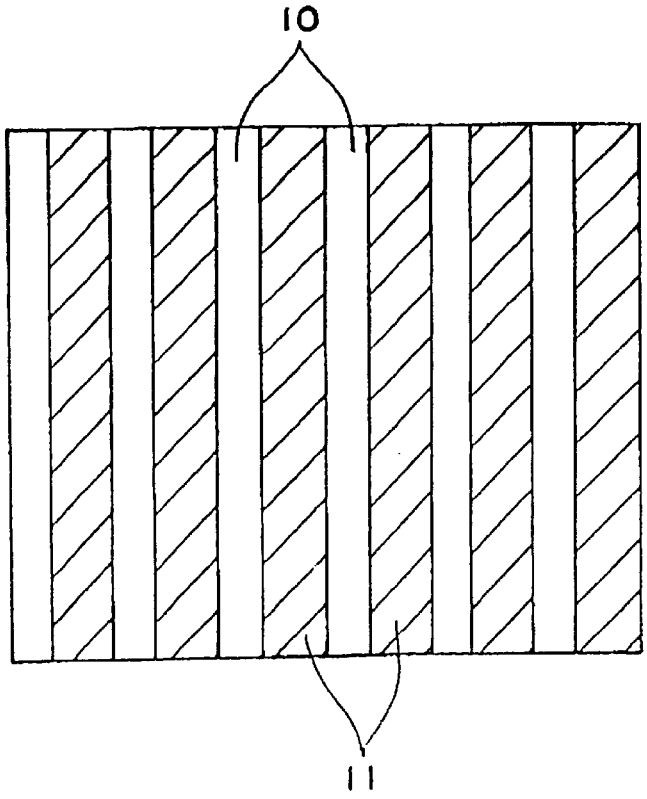
FIG. 3 is an illustration which schematically shows the other example of the composite structure (nanocomposite structure) of the magnetic powder of the present invention.

In this composite structure (nanocomposite structure), a soft magnetic phase 10 and a hard magnetic phase 11 exist with a pattern (model) as shown in, for example, FIG. 1, FIG. 2 or FIG. 3, in which the thickness of the respective phases and the grain sizes therein are on the order of nanometers. Further, the soft magnetic phase 10 and the hard magnetic phase 11 are arranged adjacent to each other (this also includes the case where these phases are adjacent through an intergranular boundary phase), which makes it possible to perform magnetic exchange interaction therebetween.

The magnetization of the soft magnetic phase readily changes its orientation by the action of an external magnetic field. Therefore, when the soft magnetic phase coexists with the hard magnetic phase, the magnetization curve for the entire system shows a stepped "serpentine curve" in the second quadrant of the B-H diagram (J-H diagram). However, when the soft magnetic phase has a sufficiently small size of less than several tens of nm, magnetization of the soft magnetic body is sufficiently and strongly constrained through the coupling with the magnetization of the surrounding hard magnetic body, so that the entire system exhibits functions like a hard magnetic body.

A magnet having such a composite structure (nanocomposite structure) has mainly the following five features.

(1) In the second quadrant of the B-H diagram (J-H diagram), the magnetization springs back reversively (in this sense, such a magnet is also referred to as a "spring magnet").

(2) It has a satisfactory magnetizability, so that it can be magnetized with a relatively low magnetic field.

(3) The temperature dependence of the magnetic properties is small as compared with the case where the system is constituted from a hard magnetic phase alone.

(4) The changes in the magnetic properties with the elapse of time are small.

(5) No deterioration in the magnetic properties is observable even if it is finely milled.

As described above, the magnets constituted from the composite structure have excellent magnetic properties. Therefore, it is preferred that the magnetic powder according to the present invention has such a composite structure.

In this regard, it is to be understood that the patterns shown in FIGS. 1 to 3 are mere examples, and the composite structure is not limited thereto.

Further, the magnetic powder of the present invention includes particles each of which is formed with a number of ridges (projecting portions) or recesses on at least a part of a surface thereof. This causes the following effects.

When such magnetic powder is used to manufacture a bonded magnet, a binding resin (binder) enters the recesses (or the gaps between the ridges). Accordingly, the bonding strength between the magnetic powder and the binding resin is enhanced, and therefore it is possible to obtain high mechanical strength with a relatively small amount of the binding resin. This means that the amount (content) of the magnetic powder to be contained can be increased, so that it becomes possible to obtain a bonded magnet having high magnetic properties.

Further, since the surface of each particle of the magnetic powder is formed with a number of the ridges or recesses as described above, the magnetic powder is sufficiently in contact with the binding resin when they are kneaded, that is the wettability therebetween is increased. With this result, in the compound of the magnetic powder and binding resin, the binding resin is apt to cover or surround the individual particles of the magnetic powder, so that it is possible to obtain a good moldability with a relatively small amount of the binding resin.

By these effects described above, it is possible to manufacture a bonded magnet having high mechanical strength and high magnetic properties with good moldability.

In this invention, when the mean particle size (diameter) of the magnetic powder is defined by a$\mu$m (the preferred value assigned to "a" will be described later), the length of the ridge or recess should preferably be equal to or greater than a/40 $\mu$m, and more preferably equal to or greater than a/30 $\mu$m.

If the length of the ridge or recess is less than a/40 $\mu$m, there is a case that the effects of the present invention described above will not be sufficiently exhibited depending on the value "a" of the mean particle size.

The average height of the ridges or the average depth of the recesses is preferably 0.1–10 $\mu$m and more preferably 0.3–5 $\mu$m.

If the average height of the ridges or the average depth of the recesses lies within this range, a binding resin comes to enter the recesses (that is, gaps between the ridges) necessarily and sufficiently when a bonded magnet is manufactured from such a magnetic powder, so that the bonding strength between the magnetic powder and the binding resin is further enhanced. With this result, the mechanical strength and magnetic properties of the obtained bonded magnet are further improved.

Figure 4:
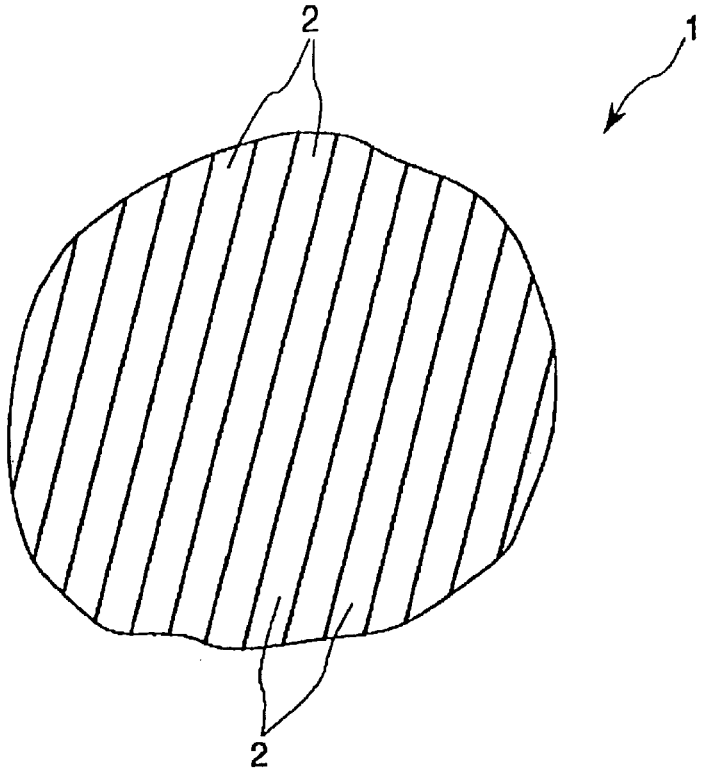
FIG. 4 is an illustration which schematically shows an example of the ridges or recesses formed on the outer surface of the particle of the magnetic powder.
Figure 5:
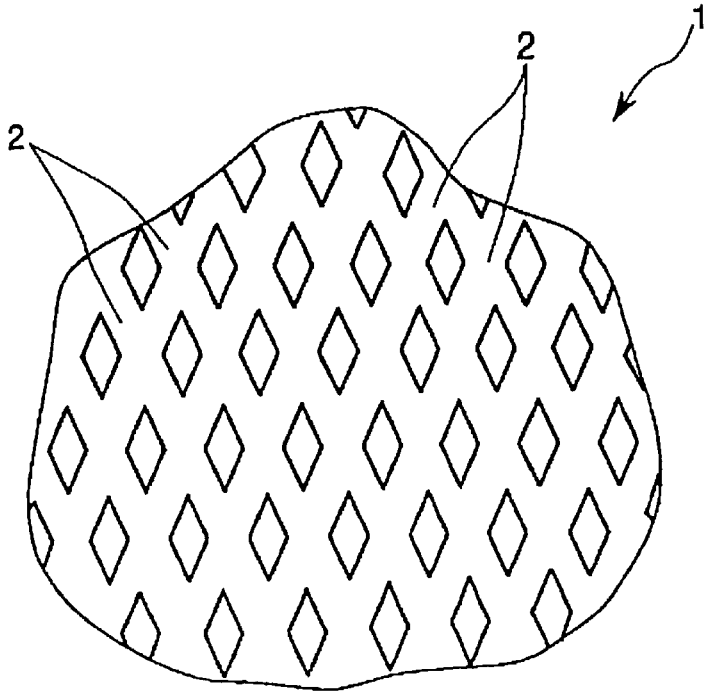
FIG. 5 is an illustration which schematically shows another example of the ridges or recesses formed on the outer surface of the particle of the magnetic powder.

These ridges or recesses may be arranged in the random directions, but it is preferred that they are oriented with each other along a predetermined direction. For examples, as shown in FIG. 4, a number of ridges 2 or recesses may be arranged roughly in parallel with each other, and as shown in FIG. 5, a number of ridges 2 or recesses may be arranged so as to extend in different two directions to interlace with each other. Further, these ridges or recesses may be formed into a wrinkle-like manner. Furthermore, in the case where the ridges or recesses are arranged with a certain directionality, it is not necessary that these ridges or recesses have the same length and height and the same shape, and they are varied in the respective ridges or recesses.

In this connection, it is preferred that the average pitch of the adjacent two ridges 2 or recesses is 0.5–100 $\mu$m, and more preferably 3–50 $\mu$m. When the average pitch of the adjacent two ridges 2 or recesses is within this range, the effects of the present invention described above are more conspicuous.

Further, it is also preferred that a ratio of an area of the part of the particle of the magnetic powder 1 where the ridges 2 or recesses are formed with respect to the entire surface area of the particle is equal to or greater than 15%, and more preferably equal to or greater than 25%. If the ratio of the area of the part of the particle where the ridges or recesses are formed with respect to the entire surface area of the particle is less than 15%, there is a case that the effects of the present invention described above are not sufficiently exhibited.

The mean particle size (diameter) "a" of the magnetic powder 1 should preferably lie within the range of 5–300 $\mu$m and more preferably lie within the range of 10–200 $\mu$m. If the mean particle size "a" of the magnetic powder 1 is less than the lower limit value, deterioration in the magnetic properties which are caused by oxidation becomes conspicuous. Further, a problem arises in handling the magnetic powder since there is a fear of firing. On the other hand, if the mean particle size "a" of the magnetic powder 1 exceeds the above upper limit value, there is a case that sufficient fluidity of the compound can not be obtained during the kneading process or molding process when the magnetic powder is used to manufacture a bonded magnet described later.

Further, in order to obtain more satisfactory moldability at the molding process when the magnetic powder is formed into a bonded magnet, it is preferred that there is a certain distribution in the particle sizes of the magnetic powder (dispersion in the particle sizes). This makes it possible to decrease a void ratio of the obtained bonded magnet, so that it is possible to increase the density and mechanical strength of the obtained bonded magnet as compared with a bonded magnet having the same content of the magnetic powder, thereby enabling to further enhance the magnetic properties.

In this regard, it is to be noted that the mean particle size "a" can be measured by the Fischer Sub-Sieve Sizer method (F.S.S.S.), for example.

Further, the magnetic powder 1 may be subjected to at least one heat treatment for the purpose of, for example, acceleration of recrystallization of the amorphous structure and homogenization of the structure during the manufacturing process or after manufacture thereof. The conditions of this heat treatment may be, for example, a heating in the range of 400 to 900° C. for 0.2 to 300 minutes.

In this case, in order to prevent oxidation, it is preferred that this heat treatment is performed in a vacuum or under a reduced pressure (for example, in the range of $1\times10^{-1}$ to $1\times10^{-6}$Torr), or in a nonoxidizing atmosphere of an inert gas such as nitrogen gas, argon gas, helium gas or the like.

In such magnetic powder as described above, the average crystal grain size should preferably be equal to or less than 500 nm, more preferably equal to or less than 200 nm, and most preferably lie in the range of 10–120 nm. If the average crystal grain size exceeds 500 nm, there is a case that magnetic properties, especially coercive force and rectangularity can not be sufficiently improved.

In particular, when the magnetic material for the magnetic powder is an alloy having the composite structure as described (4) in the above, the average crystal grain size should preferably lie in the range of 1–100 nm, and more preferably lie in the range of 5–50 nm. When the average crystal grain size lies in this range, more effective magnetic exchange interaction occurs between the soft magnetic phase 10 and the hard magnetic phase 11, so that markedly improved magnetic properties can be recognized.

The magnetic powder described above may be manufactured by various manufacturing methods if at least a part of the surface of the particle of the magnetic powder is formed with ridges or recesses. However, it is preferred that the magnetic powder is obtained by milling a ribbon-shaped magnetic material (melt spun ribbon) manufactured by a quenching method using a cooling roll, from the view points that metal structure (crystal grain) can be formed into a microstructure with relative ease and that magnetic properties especially coercive force can be effectively enhanced.

In this connection, it is to be understood that only the particles having surfaces which have constituted a part of a roll contact surface of the melt spun ribbon (a surface of the melt spun ribbon which was in contact with the cooling roll) are formed with the ridges or recesses. Particles obtained from the melt spun ribbon but having no such surfaces do not have such ridges or recesses.

The milling method of the melt spun ribbon is not particularly limited, and various kinds of milling or crushing apparatus such as ball mill, vibration mill, jet mill, and pin mill may be employed. In this case, in order to prevent oxidation, the milling process may be carried out in vacuum or under a reduced pressure (for example, under a reduced pressure of $1\times10^{-1}$ to $1\times10^{-6}$Torr), or in a nonoxidizing atmosphere of an inert gas such as nitrogen, argon, helium, or the like.

The magnetic powder having such ridges or recesses may be formed by appropriately selecting its alloy composition, a material of the outer surface layer of the cooling roll, a structure of the outer surface layer of the cooling roll, and cooling conditions and the like. However, in the present invention, in order to form the ridges or recesses surely with controlling their shapes appropriately, it is preferred that grooves (recesses) or projections (ridges) are formed on the circumferential surface of the cooling roll so that the shapes or forms of them are transferred to a melt spun ribbon.

When the cooling roll having the circumferential surface formed with the grooves or projections described above is used with a single roll method, it is possible to form corresponding ridges or recesses on at least one surface of the melt spun ribbon. Further, in a twin roll method, it is possible to form corresponding ridges or recesses on both surfaces of the melt spun ribbon by using two cooling rolls each having the circumferential surface formed with the grooves or projections.

Hereinbelow, a description will be made with regard to a bonded magnet according to the present invention.

Preferably, the bonded magnet according to the present invention is manufactured by binding the magnetic powder described above using a binding resin (binder).

As for the binding resin, either of thermoplastic resins or thermosetting resin may be employed.

Examples of the thermoplastic resins include polyamid (example: nylon 6, nylon 46, nylon 66, nylon 610, nylon 612, nylon 11, nylon 12, nylon 6-12, nylon 6-66); thermoplastic polyimide; liquid crystal polymer such as aromatic polyester; poly phenylene oxide; poly phenylene sulfide; polyolefin such as polyethylene, polypropylene and ethylene-vinyl acetate copolymer; modified polyolefin; polycarbonate; poly methyl methacrylate; polyester such as poly ethylen terephthalate and poly butylene terephthalate; polyether; polyether ether ketone; polyetherimide; polyacetal; and copolymer, blended body, and polymer alloy having at least one of these materials as a main ingredient. In this case, a mixture of two or more kinds of these materials may be employed.

Among these resins, a resin containing polyamide as its main ingredient is particularly preferred from the viewpoint of especially excellent moldability and high mechanical strength. Further, a resin containing liquid crystal polymer and/or poly phenylene sulfide as its main ingredient is also preferred from the viewpoint of enhancing the heat resistance. Furthermore, these thermoplastic resins also have an excellent kneadability with the magnetic powder.

These thermoplastic resins provide an advantage in that a wide range of selection can be made. For example, it is possible to provide a thermoplastic resin having a good moldability or to provide a thermoplastic resin having good heat resistance and mechanical strength by appropriately selecting their kinds, copolymerization or the like.

On the other hand, examples of the thermosetting resin include various kinds of epoxy resins of bisphenol type, novolak type, and naphthalene-based, phenolic resins, urea resins, melamine resins, polyester (or unsaturated polyester) resins, polyimide resins, silicone resins, polyurethane resins, and the like. In this case, a mixture of two or more kinds of these materials may be employed.

Among these resins, the epoxy resins, phenolic resins, polyimide resins and silicone resins are preferable from the viewpoint of their special excellence in the moldability, high mechanical strength, and high heat resistance. In these resins, the epoxy resins are especially preferable. These thermosetting resins also have an excellent kneadability with the magnetic powder and homogeneity (uniformity) in kneading.

The unhardened thermosetting resin to be used may be either in a liquid state or in a solid (powdery) state at a room temperature.

The bonded magnet according to this invention described in the above may be manufactured, for example, as in the following.

First, the magnetic powder, a binding resin and an additive (antioxidant, lubricant, or the like) as needed are mixed and kneaded to obtain a bonded magnet composite (compound). Then, thus obtained bonded magnet composite is formed into a desired magnet shape or form in a space free from magnetic field by a molding method such as compaction molding (press molding), extrusion molding, or injection molding. When the binding resin used is a thermosetting type, the obtained mold body is hardened by heating or the like after molding.

In this case, the kneading process may be carried out at a room temperature, but it is preferable that the kneading process is carried out at or above a temperature that the used binding resin begins to soften. In particular, when the binding resin is a thermosetting resin, it is preferable that the kneading process is carried out at or above a temperature that the used binding resin begins to soften and below a temperature that the binding resin begins to harden.

By carrying out the kneading process under these temperatures, the efficiency of the kneading process is improved so that the kneading can be made uniformly in a relatively short time as compared with the case where the kneading is carried out at a room temperature. Further, since the kneading is carried out under the state that viscosity of the binding resin is low, the binding resin becomes sufficiently and reliably in contact with the magnetic powder, and thereby the binding resin which has been softened or melted effectively enters the recesses or the gaps between the ridges. With this result, the void ratio of the compound can be made small. Further, this also contributes to reducing the amount of the binding resin to be contained in the compound.

Further, it is also preferred that the molding process in accordance with any one of the methods mentioned above is carried out under the temperatures that the binding resin is being softened or melted (warm molding).

By carrying out the molding under such temperatures, the fluidity of the binding resin is improved, so that excellent moldability can be secured even in the case where a relatively small amount of the binding resin is used. Further, since the fluidity of the binding resin is improved, the binding resin becomes sufficiently and reliably in contact with the magnetic powder, and thereby the binding resin which has been softened or melted effectively enters the recesses or the gaps between the ridges. With this result, the void ratio of the obtained bonded magnet can be made small, so that it is possible to manufacture a bonded magnet having a high density and excellent magnetic properties and mechanical strength.

One example of the indexes for indicating the mechanical strength is mechanical strength obtained by a shear strength by punching-out test known as "Testing Method of Measuring Shear Strength by Punching-out Small Specimen of Bonded Magnets" which is determined by the standard of Electronic Materials Manufactures Association of Japan under the code number of EMAS-7006. In the case of the bonded magnet of the present invention, the mechanical strength of the bonded magnet according to this test should preferably be equal to or larger than 50 MPa and more preferably be equal to or larger than 60 MPa.

The content of the magnetic powder in the bonded magnet is not particularly limited, and it is normally determined by considering the kind of the molding method to be used and the compatibility of moldability and high magnetic properties. For example, it is preferred that the content is in the range of 75–99.5 wt %, and more preferably in the range of 85–97.5 wt %.

In particular, in the case of a bonded magnet manufactured by the compaction molding method, the content of the magnetic powder should preferably lie in the range of 90–99.5 wt %, and more preferably in the range of 93–98.5 wt %.

Further, in the case of a bonded magnet manufactured by the extrusion molding or the injection molding, the content of the magnetic powder should preferably lie in the range of 75–98 wt %, and more preferably in the range of 85–97 wt %.

In this invention, since the ridges or recesses are formed on at least a part of the outer surface of the particle of the magnetic powder, the magnetic powder can be bonded with the binding resin with large bonding strength. For this reason, high mechanical strength can be obtained with a relatively small amount of the binding resin to be used. As a result, it becomes possible to increase the amount of the magnetic powder to be contained, so that a bonded magnet having high magnetic properties can be obtained.

The density ρ of the bonded magnet is determined by factors such as the specific gravity of the magnetic powder to be contained in the bonded magnet, the content of the magnetic powder, and the void ratio (porosity) of the bonded magnet and the like. In the bonded magnets according to this invention, the density ρ is not particularly limited to a specific value, but it is preferable to be in the range of 5.3–6.6 $Mg/m^3$, and more preferably in the range of 5.5–6.4 $Mg/m^3$.

In this invention, the shapes (forms), dimensions and the like of the bonded magnet are not particularly limited. For example, as to the shape, all shapes such as columnar shape, prism-like shape, cylindrical shape (annular shape), arched shape, plate-like shape, curved plate-like shape, and the like are acceptable. As to the dimensions, all sizes starting from large-sized one to ultraminuaturized one are acceptable. However, as repeatedly described in this specification, the present invention is particularly advantageous when it is used for miniaturized magnets and ultraminiaturized magnets.

Further, in the present invention, it is preferred that the coercive force ($H_{CJ}$) (intrinsic coercive force at a room temperature) of the bonded magnet lies in the range of 320 to 1200 kA/m, and more preferably in the range of 400 to 800 kA/m. If the coercive force ($H_{CJ}$) is lower than the lower limit value, demagnetization occurs conspicuously when a reverse magnetic field is applied, and the heat resistance at a high temperature is deteriorated. On the other hand, if the coercive force ($H_{CJ}$) exceeds the above upper limit value, magnetizability is deteriorated. Therefore, by setting the coercive force ($H_{CJ}$) to the above range, in the case where the bonded magnet is subjected to multipolar magnetization, a satisfactory magnetization can be accomplished even when a sufficiently high magnetizing field cannot be secured. Further, it is also possible to obtain a sufficient magnetic flux density, thereby enabling to provide high performance bonded magnets.

Furthermore, in the present invention, it is preferable that the maximum magnetic energy product $(BH)_{max}$ of the bonded magnet is equal to or greater than 40 $kJ/m^3$, more preferably equal to or greater than 50 kJ/m$^3$, and most preferably in the range of 70 to 120 kJ/m$^3$. When the maximum magnetic energy product $(BH)_{max}$ is less than 40 kJ/m$^3$, it is not possible to obtain a sufficient torque when used for motors depending on the types and structures thereof.

EXAMPLES

Hereinbelow, the actual examples of the present invention will be described.

Example 1

By using a melt spinning apparatus having a cooling roll, magnetic powders made of an alloy composition represented by the formula of $(Nd_{0.75}Pr_{0.2}Dy_{0.05})_{8.9}Fe_{bal.}Co_{8.0}B_{5.7}$ were manufactured in accordance with the following method.

As for the cooling roll, five cooling rolls each having grooves in the circumferential surface thereof were prepared. The grooves of these five cooling rolls were different from with each other. Namely, the average depth of the grooves, the average length of the grooves and the average pitch between the adjacent grooves are different in each of the cooling rolls.

By using the melt spinning apparatus equipped with one of these cooling rolls, melt spun ribbons were manufactured by the single roll method. Namely, different five types of melt spun ribbons were manufactured by using the five types of cooling rolls which were replaced one after another for each of the melt spun ribbons.

In manufacturing each melt spun ribbon, first, an amount (basic weight) of each of the materials Nd, Pr, Dy, Fe, Co and B was weighed, and then a mother alloy ingot was manufactured by casting these materials.

Next, a chamber in which the melt spinning apparatus is installed was vacuumed, and then an inert gas (Helium gas) was introduced to create a desired atmosphere of predetermined temperature and pressure.

Next, a molten alloy was formed by melting the mother alloy ingot, and the peripheral velocity of the cooling roll was set to be 28 m/sec. Then, after the pressure of the ambient gas was set to be 60 kPa and the injection pressure of the molten alloy was set to be 40 kPa, the molten alloy was injected toward the circumferential surface of the cooling roll, to manufacture a melt spun ribbon continuously. The thickness of each of the obtained melt spun ribbons was 17 $\mu$m.

After milling each of the thus obtained melt spun ribbons, they were subjected to a heat treatment in an argon gas atmosphere at a temperature of 675° C. for 300 sec to obtain magnetic powders of the present invention (sample No. 1–No. 5).

In addition, using a cooling roll having a flat circumferential surface (no groove nor ridges), magnetic powders (sample No. 6 and No. 7) were manufactured in the same way as that described above (Comparative Examples).

The surface conditions of thus obtained magnetic powders were observed using a scanning electron microscope (SEM). As a result, it was confirmed that the particles of each of the magnetic powders of the sample No. 1 to No. 5 were formed with ridges corresponding to the grooves of each cooling roll. On the other hand, no such ridges nor recesses were observed on the surfaces of the particles of the magnetic powders of the sample No. 6 and No. 7 (Comparative Examples).

Figure 6:
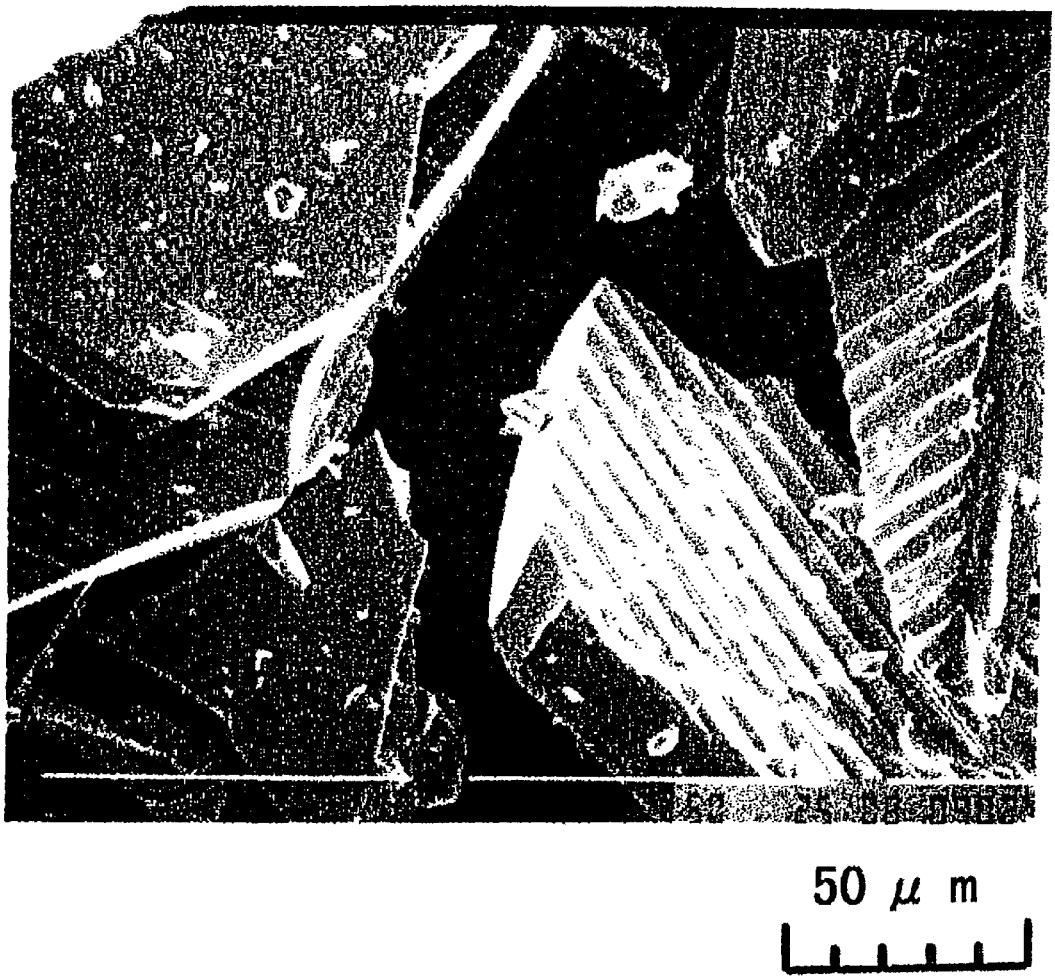
FIG. 6 is an electronograph of the magnetic powder according to the present invention.

The electronograph of the magnetic powder (sample No. 2) of the present invention is shown in FIG. 6.

Then, for each of the magnetic powders, the height and length of the ridges formed on the surface of the particle and the pitch between the adjacent ridges were measured. Further, based on the observation results by the scanning electron microscope (SEM), a ratio of the area of a part of the surface of the particle where the ridges or recesses are formed with respect to the entire surface area of the particle was also obtained for each of the magnetic powders. These results are shown in the attached Table 1.

To analyze the phase structure of the obtained magnetic powders, the respective magnetic powders were subjected to an X-ray diffraction test using Cu—K$\alpha$ line at the diffraction angle (2$\theta$) of 20°–60°. With this result, from the diffraction pattern of the respective magnetic powders, it was confirmed that there were a diffraction peak of a hard magnetic phase of $R_2(Fe.Co)_{14}B$ phase and a diffraction peak of a soft magnetic phase of $\alpha$-(Fe, Co) phase. Further, from the observation results by the transmission electron microscope (TEM), the respective magnetic powders have a composite structure (nanocomposite structure). Furthermore, in each of the magnetic powders, an average crystal grain size of each of these phases was also measured. These measured values are shown in the attached Table 1.

Next, each of the magnetic powders was mixed with an epoxy resin and a small amount of hydrazine based antioxidant, and then each mixture was kneaded at a temperature of 100° C. for 10 minutes (warm kneading), thereby obtaining compositions for bonded magnets (compounds).

In this connection, it is to be noted that in each of the samples No. 1–No. 6, the mixing ratio of the magnetic powder, epoxy resin and hydrazine based antioxidant was 97.5 wt %:1.3 wt %:1.2 wt %. Further, in the sample No. 7, the mixing ratio of the magnetic powder, epoxy resin and hydrazine based antioxidant was 97.0 wt %: 2.0 wt %: 1.0 wt %.

Thereafter, each of the thus obtained compounds was milled or crushed to be granular. Then, the granular substance (particle) was weighed and filled into a die of a press machine, and then it was subjected to compaction molding (in the absence of a magnetic field) at a temperature of 120° C. and under the pressure of 600 MPa (that is, warm molding was carried out), to obtain a mold body. Thereafter, the mold body was cooled and then it was removed from the die, and then it was heated at a temperature of 175° C. to harden the epoxy resin. In this way, a bonded magnet of a columnar shape having a diameter of 10 mm and a height of 7 mm (for the test for magnetic properties and heat resistance) and a bonded magnet of a flat plate shape having a length of 10 mm, a wide of 10 mm and a height of 3 mm (for the test for mechanical strength) were obtained. In this regard, it is to be noted that as for such a flat plate shape bonded magnet, five pieces were manufactured in each sample.

As a result, it was confirmed that the bonded magnets of the sample No. 1–No. 5 (manufactured according to this invention) and the sample No. 7 (Comparative Example) could be manufactured with good moldability.

Further, after pulse magnetization was performed for each of the columnar-shaped bonded magnets under the magnetic field strength of 3.2 MA/m, magnetic properties (coercive force $H_{CJ}$, remanent magnetic flux density Br, and maximum magnetic energy product $(BH)_{max}$) were measured using a DC recording fluxmeter (manufactured and sold by Toei Industry Co. Ltd with the product code of TRF-5BH) under the maximum applied magnetic field of 2.0 MA/m. The temperature at the measurement was 23° C. (that is, the room temperature).

Next, a test for heat resistance (heat stability) was conducted. In this heat resistance test, a value of irreversible flux loss (initial flux loss) was measured for each bonded magnet at the time when the temperature was back to the room temperature after the bonded magnet had been being placed under the condition of 100° C. for one hour, and then the results were evaluated. In this regard, it is to be noted that the smaller absolute values of the irreversible flux loss (initial flux loss) are superior in the heat resistance (heat stability).

Further, for each of the flat plate shaped bonded magnets, the mechanical strength thereof was measured by the shear strength by punching-out test. In the test, the auto-graph manufactured by Simazu Corporation was used as a testing machine, and the test was carried out under the shearing rate of 1.0 mm/min using a shearing punch (of which diameter was 3 mm).

Furthermore, after the measurements of the mechanical strength, the state of the cross-sectional plane of each bonded magnet was observed by the scanning electron microscope (SEM). As a result, it was confirmed that in the bonded magnets of the sample No. 1–No. 5 (according to the present invention), the binding resin effectively entered the recesses or the gaps between the ridges.

The results of the measurements of the magnetic properties, heat resistance and mechanical strength are shown in the attached Table 2.

As seen from the attached Table 2, each of the bonded magnets of the sample No. 1–No. 5 according to the present invention had excellent magnetic properties, heat resistance and mechanical strength, respectively.

In contrast, in the bonded magnet of the sample No. 6 (Comparative Example), it was confirmed that its mechanical strength was low, and in the bonded magnet of the sample No. 7 (Comparative Example), it was confirmed that the magnetic properties were poor. This is supposed to be resulted from the following reasons.

Namely, in the bonded magnets of the sample No. 1–No. 5 according to the present invention, since the ridges were formed on the outer surface of the particle of the magnetic powder, the binding resin entered the gaps between the ridges effectively. Therefore, the bonding strength between the magnetic powder and the binding resin was increased, so that it was possible to obtain high mechanical strength with a relatively small amount of the binding resin. Further, since the small amount of the binding resin was used, the density of the bonded magnet becomes high, thus resulting in the excellent magnetic properties.

On the other hand, in the bonded magnet of the sample No. 6 (Comparative Example), although the same amount of the binding resin as that of the bonded magnet of the present invention was used, the bonding strength between the magnetic powder and the biding resin was low as compared with the bonded magnet of the present invention, thus resulting in the poor mechanical strength.

Further, in the bonded magnet of the sample No. 7 (Comparative Example), since a relatively large amount of the binding resin was used in order to increase the moldability and mechanical strength, the amount of the magnetic powder was relatively reduced, so that the magnetic properties became poor.

EFFEICTS OF THE INVENTION

As described above, according to the present invention, the following effects can be obtained.

Since the ridges or recesses are formed on at least a part of the surface of the particle of the magnetic powder, the bonding strength between the magnetic powder and the binding resin is increased, so that it is possible to obtain a bonded magnet having high mechanical strength.

Further, since a bonding magnet having excellent moldability and higher mechanical strength can be obtained with a relatively small amount of the binding resin, it becomes possible to increase the amount of the magnetic power to be contained and to reduce the void ratio, so that a boded magnet having high magnetic properties can be obtained.

Furthermore, since the magnetic powder is constituted from a composite structure having a hard magnetic phase and a soft magnetic phase, a bonded magnet formed from the magnetic powder can exhibit more excellent magnetic properties. In particular, intrinsic coercive force and rectangularity can be enhanced.

Moreover, since a high density bonded magnet can be obtained, it is possible to provide a bonded magnet which can exhibit more excellent magnetic properties with a smaller volume as compared with the conventional isotropic bonded magnets.

Moreover, since the magnetic powder is securedly bonded with the binding resin, a magnet formed from the magnetic powder can have higher corrosion resistance even if it is formed into a high density bonded magnet.

Finally, it is to be understood that the present invention is not limited to Examples described above, and many changes or additions may be made without departing from the scope of the invention which is determined by the following claims.

TABLE 1

| Sample No. | Mean Particle Size of Magnetic Powder (μm) | Average Height of Ridges (μm) | Average Length of Ridges (μm) | Average Pitch between Adjacent Ridges (μm) | Ratio of Area of Part of Particle Where Ridges or Recesses Are Formed With Respect To Entire Surface Area of Particle (%) | Average Crystal Grain Size (nm) |
|---|---|---|---|---|---|---|
| This Invention 1 | 25 | 0.3 | 6 | 1.0 | 17 | 37 |
| This Invention 2 | 120 | 1.5 | 55 | 10.0 | 33 | 26 |
| This Invention 3 | 85 | 2.2 | 38 | 35.3 | 21 | 31 |
| This Invention 4 | 160 | 3.3 | 70 | 62.3 | 39 | 35 |
| This Invention 5 | 200 | 4.5 | 112 | 95.1 | 42 | 38 |
| Comp. Ex. 6 | 120 | — | — | — | — | 42 |
| Comp. Ex. 7 | 75 | — | — | — | — | 40 |

TABLE 2

| Sample No. | Content of Magnetic Powder (%) | $H_{CJ}$ (kA/m) | Br (T) | $(BH)_{max}$ (kJ/m$^3$) | Irreversible Flux Loss (%) | Mechanical Strength (MPa) |
|---|---|---|---|---|---|---|
| This Invention 1 | 97.5 | 533 | 0.86 | 102 | −4.6 | 80 |
| This Invention 2 | 97.5 | 571 | 0.88 | 118 | −2.9 | 83 |
| This Invention 3 | 97.5 | 563 | 0.88 | 112 | −3.1 | 86 |
| This Invention 4 | 97.5 | 550 | 0.87 | 107 | −3.5 | 90 |
| This Invention 5 | 97.5 | 528 | 0.86 | 99 | −4.9 | 92 |
| Comp. Ex. 6 | 97.5 | 472 | 0.84 | 92 | −8.5 | 48 |
| Comp. Ex. 7 | 97.0 | 512 | 0.79 | 80 | −5.4 | 88 |

What is claimed is:

1. A magnetic powder comprising:

an alloy composition including a rare-earth element and a transition metal, the alloy composition being selected from the group consisting of Sm—Co based alloys, R—TM—B based alloys, Sm—Fe—N alloys, alloys having a composite structure in which a soft magnetic phase and a hard magnetic phase are adjacent one another, and mixtures of the alloys thereof, wherein R of the R—TM—B based alloy is at least one rare-earth element selected from the group consisting of La, Ce, Pr, Pm, Nd, Sm, Eu, Gd, Tb, Dy, Ho, Er, Tm, Yb, Lu, and misch metal; and wherein the magnetic powder includes particles each of which is formed with a number of ridges or recesses on at least a part of the surface thereof; and the ridges or recesses are arranged parallel with each other to have an average pitch of 1.0–35.3 $\mu$m.

2. The magnetic powder as claimed in claim 1, wherein when the mean particle size of the magnetic powder is defined by a$\mu$m, the average length of the ridges or recesses is equal to or greater than a/40 $\mu$m.

3. The magnetic powder as claimed in claim 1, wherein the average height of the ridges or the average depth of the recesses is 0.3–5 $\mu$m.

4. The magnetic powder as claimed in claim 1, wherein the magnetic powder has been produced by milling a melt spun ribbon manufactured using a cooling roll.

5. The magnetic powder as claimed in claim 1, wherein the means particle size of the magnetic powder is 5–300 $\mu$m.

6. The magnetic powder as claimed in claim 1, wherein the ratio of an area of the part of the surface the particle where the ridges or recesses are formed with respect to an entire surface area of the particle is equal to or greater than 15%.

7. The magnetic powder as claimed in claim 1, wherein the magnetic powder has been subjected to a heat treatment during the manufacturing process thereof or after the manufacture thereof.

8. The magnetic powder as claimed in claim 1, wherein the magnetic powder is composed of a composite structure having a hard magnetic phase and a soft magnetic phase.

9. The magnetic powder as claimed in claim 8, wherein the average crystal grain size of each of the hard magnetic phase and the soft magnetic phase is 1–100 nm.

10. A bonded magnet which has been manufactured by binding the magnetic powder as claimed in claim 1, with a binding resin.

11. The bonded magnet as claimed in claim 10, wherein the bonded magnet was manufactured by means of warm molding.

12. The bonded magnet as claimed in claim 10, wherein the binding resin enters the recesses or the gaps between the ridges of the particles.

13. The bonded magnet as claimed in claim 10, wherein the intrinsic coercive force $H_{CJ}$ at a room temperature is 320–1200 kA/m.

14. The bonded magnet as claimed in claim 10, wherein the maximum energy product $(BH)_{max}$ is equal to or greater than 4 kJ/m$^3$.

15. The bonded magnet as claimed in claim 10, wherein the content of the magnetic powder in the bonded magnet is 75–99.5 wt %.

16. The bonded magnet as claimed in claim 10, wherein the mechanical strength of the bonded magnet which is measured by the shear strength by punching-out test is equal to or greater than 50 MPa.

17. A magnetic powder comprising:

an alloy composition including a rare earth element and a transition metal, the alloy composition being selected from the group consisting of Sm—Co based alloys, R—TM—B based alloys; Sm—Fe—N alloys, and mixtures of the alloys thereof, wherein R of the R—TM—B based alloy is at least one rare-earth element selected from the group consisting of La, Ce, Pr, Nd, Pm, Sm, Eu, Gd, Tb, Dy, Ho, Er, Tm, Yb, Lu, and misch metal; and wherein the magnetic powder includes particles each of which is formed with a number of ridges or recesses on at least a part of a surface thereof and arranged parallel with each other to have an average pitch of 1.0–35.3 $\mu$m;

the magnetic powder is composed of a composite structure having a soft magnetic phase and a hard magnetic; and the soft magnetic phase and hard magnetic phase have an average crystal grain size of 2–100 nm.

* * * * *